US011332817B2

(12) United States Patent
Sato et al.

(10) Patent No.: US 11,332,817 B2
(45) Date of Patent: May 17, 2022

(54) MACHINE COMPONENT

(71) Applicant: KOMATSU LTD., Tokyo (JP)

(72) Inventors: Kensuke Sato, Tokyo (JP); Koji Yamamoto, Tokyo (JP); Yusuke Hiratsuka, Himeji (JP); Kazuya Hashimoto, Himeji (JP)

(73) Assignee: KOMATSU LTD., Tokyo (JP)

( * ) Notice: Subject to any disclaimer, the term of this patent is extended or adjusted under 35 U.S.C. 154(b) by 0 days.

(21) Appl. No.: 17/046,064

(22) PCT Filed: May 10, 2019

(86) PCT No.: PCT/JP2019/018692

§ 371 (c)(1),
(2) Date: Oct. 8, 2020

(87) PCT Pub. No.: WO2019/244503

PCT Pub. Date: Dec. 26, 2019

(65) Prior Publication Data

US 2021/0032737 A1 Feb. 4, 2021

(30) Foreign Application Priority Data

Jun. 18, 2018 (JP) ..... JP2018-115349

(51) Int. Cl.
*C22C 38/00* (2006.01)
*C23C 8/22* (2006.01)
(Continued)

(52) U.S. Cl.
CPC ..... *C23C 8/22* (2013.01); *C21D 1/32* (2013.01); *C21D 9/32* (2013.01); *C22C 38/001* (2013.01);
(Continued)

(58) Field of Classification Search
CPC .... C23C 8/22; C21D 1/32; C21D 9/32; C21D 2211/003; C22C 38/001; C22C 38/02;
(Continued)

(56) References Cited

U.S. PATENT DOCUMENTS

2004/0094238 A1 5/2004 Kinami et al.
2005/0247377 A1* 11/2005 Takayama ..... C23C 8/80 148/319
(Continued)

FOREIGN PATENT DOCUMENTS

CN 105239017 A 1/2016
EP 2530178 A1 * 12/2012 ..... C22C 38/02
(Continued)

*Primary Examiner* — Humera N. Sheikh
*Assistant Examiner* — John D Schneible
(74) *Attorney, Agent, or Firm* — Oliff PLC

(57) ABSTRACT

A machine component includes a core made up of a steel for machine structural use, and a medium carbon-containing layer and a high carbon-containing layer formed of the steel for machine structural use, the medium carbon-containing layer covering the core, the high carbon-containing layer covering the medium carbon-containing layer and having a carbon concentration of 0.8-1.5%. The high carbon-containing layer is made up of a martensitic structure having carbides dispersed therein and a residual austenitic structure, wherein spheroidized carbides with an aspect ratio of 1.5 or less constitute 90% or more of a total number of the carbides, and the number of spheroidized carbides on prior austenite grain boundaries is 40% or less of the total number of the carbides.

5 Claims, 3 Drawing Sheets

(51) Int. Cl.

| | |
|---|---|
| ***C21D 1/32*** | (2006.01) |
| ***C21D 9/32*** | (2006.01) |
| ***C22C 38/02*** | (2006.01) |
| ***C22C 38/04*** | (2006.01) |
| ***C22C 38/06*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/54*** | (2006.01) |
| ***C23C 8/80*** | (2006.01) |

(52) U.S. Cl.
CPC ..... *C22C 38/002* (2013.01); *C22C 38/02* (2013.01); *C22C 38/04* (2013.01); *C22C 38/06* (2013.01); *C22C 38/44* (2013.01); *C22C 38/46* (2013.01); *C22C 38/48* (2013.01); *C22C 38/50* (2013.01); *C22C 38/54* (2013.01); *C23C 8/80* (2013.01); *C21D 2211/003* (2013.01); *Y10T 428/12458* (2015.01); *Y10T 428/12771* (2015.01); *Y10T 428/12861* (2015.01); *Y10T 428/12951* (2015.01); *Y10T 428/12972* (2015.01)

(58) Field of Classification Search
CPC ..... C22C 38/04; C22C 38/06; C22C 38/44; C22C 38/46; C22C 38/48; C22C 38/50; C22C 38/54; C11C 38/54; C32C 8/80; Y10T 428/12458; Y10T 428/12771; Y10T 428/12861; Y10T 428/12951; Y10T 428/12972
USPC ..... 428/615, 655, 668, 681, 682, 683; 128/225, 318
See application file for complete search history.

(56) References Cited

U.S. PATENT DOCUMENTS

| | | | | |
|---|---|---|---|---|
| 2006/0137766 | A1* | 6/2006 | Kozawa | C23C 8/22 148/319 |
| 2012/0318408 | A1 | 12/2012 | Kozawa et al. | |
| 2013/0048156 | A1* | 2/2013 | Hashimura | C21D 9/40 148/333 |
| 2013/0186522 | A1* | 7/2013 | Ichimiya | C22C 38/20 148/319 |
| 2016/0289787 | A1* | 10/2016 | Takeda | C21D 8/0273 |
| 2018/0371603 | A1* | 12/2018 | Shiga | C22C 38/04 |
| 2019/0024206 | A1* | 1/2019 | Kim | C22C 38/58 |
| 2020/0165710 | A1 | 5/2020 | Minamino et al. | |

FOREIGN PATENT DOCUMENTS

| | | | |
|---|---|---|---|
| JP | 2005-154784 | A | 6/2005 |
| JP | 2007-297676 | A | 11/2007 |
| JP | 2016-156037 | A | 9/2016 |
| JP | 2017-057479 | A | 3/2017 |
| WO | 2011/132722 | A1 | 10/2011 |

* cited by examiner

MACHINE COMPONENT

TECHNICAL FIELD

The present invention relates to a machine component that is excellent in toughness while having a surface layer hardened by carburization, which is used for a component supposed to undergo a high surface pressure.

This application claims priority based on Japanese Patent Application No. 2018-115349 filed on Jun. 18, 2018, and the entire contents of this Japanese Patent Application are incorporated herein by reference.

BACKGROUND ART

Machine components, for example, components such as gears and shafts receiving high surface pressure, are obtained by forming a steel material into a shape of the component by hot forging, cold forging, cutting and the like, and subjecting the resultant material to carburizing processing such as gas carburizing or vacuum carburizing before being used. The material may additionally be subjected to grinding, shot peening, etc. as required. Carburizing processing is processing of causing carbon to enter into a steel component from the surface, after achieving a high solid solubility limit of carbon to the steel by heating the steel to a high temperature not lower than the austenitizing temperature.

Generally, carburization allows 0.7-0.8% carbon to enter the surface of the steel component. Thereafter, the steel component is quenched. The quenching may be performed directly from the carburizing temperature, or it may be performed after cooling the steel component from the carburizing temperature to a typical quenching temperature. Alternatively, the steel component may be once cooled after the carburizing processing, and then re-heated before being quenched. The steel component is then tempered.

With recent reduction in size and weight of drive-train units as typified by transmissions in automobiles for the purpose of improving fuel efficiency, gears, shafts and the like tend to be subjected to increasingly higher loads. Particularly, the gears may suffer shortened life due to the pitting occurring on the tooth surface or tooth breakage.

On the other hand, Patent Literature 1 proposes a steel with high hardness and excellent toughness, containing a large amount of carbon, with its C content being 0.55-1.10% in mass %, the structure of the steel after quenching being a dual phase structure of martensitic structure and spheroidized carbide, with the proportion of spheroidized cementite to the entire cementite and the proportion of cementite on the prior austenite grain boundaries being controlled. With this steel, a steel component will have a carbon concentration kept high to the inside, so the required toughness may not be obtained.

CITATION LIST

Patent Literature

Patent Literature 1: Japanese Patent Application Laid-Open No. 2017-57479

SUMMARY OF INVENTION

Technical Problem

An object of the present invention is to provide a machine component that is surface-hardened and still has improved toughness as compared to the conventional techniques.

Solution to Problem

To accomplish the above object, the present invention provides a machine component as follows.

A machine component includes: a core made up of a steel for machine structural use having a component composition containing, in mass %, 0.13-0.30% C, 0.15-0.80% Si, 0.20-0.90% Mn, 0.90-2.00% Cr, 0.020-0.050% Al, and 0.002-0.025% N, also containing, as impurities, 0.030% or less P and 0.030% or less S, further optionally containing, as a first group of selective optional components, one or more selected from among 0.10-2.00% Ni, 0.05-0.50% Mo, 0.01-0.10% Nb, and 0.01-0.20% V, and optionally containing, as a second group of optional components in addition to or in place of the first group of selective optional components, 0.01-0.05% Ti and 0.0010-0.0050% B, with the balance consisting of Fe and unavoidable impurities; and a medium carbon-containing layer and a high carbon-containing layer formed of the steel for machine structural use, the medium carbon-containing layer covering the core, the high carbon-containing layer covering the medium carbon-containing layer and having a carbon concentration of 0.8-1.5%. The high carbon-containing layer is made up of a martensitic structure having carbides dispersed therein and a residual austenitic structure. In the high carbon-containing layer, spheroidized carbides with an aspect ratio of 1.5 or less constitute 90% or more of a total number of the carbides. In the high carbon-containing layer, the number of spheroidized carbides on grain boundaries of prior austenite grains is 40% or less of the total number of the carbides.

Of the spheroidized carbides on the prior austenite grain boundaries, 90% or more may have a particle size of 1 μm or less.

The prior austenite grain boundaries may provide a grain size of 15 μm or less.

The high carbon-containing layer may be formed at least from a surface to 0.3 mm in depth of the machine component.

Effects of the Invention

The machine component according to the above solutions, having the core made up of the steel for machine structural use having the component composition according to the above solution, and the surface layer including the high carbon-containing layer formed of the steel for machine structural use and having a carbon concentration of 0.8-1.5%, is excellent in pitting resistance characteristics and toughness, so a machine component supposed to undergo a high surface pressure can suitably be obtained.

DESCRIPTION OF EMBODIMENT

Figure 1:
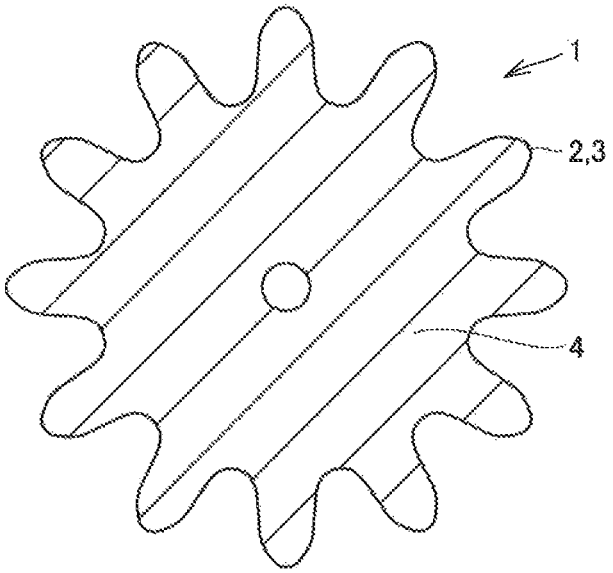
FIG. 1 shows a cross section of a machine component of an embodiment.
Figure 2:
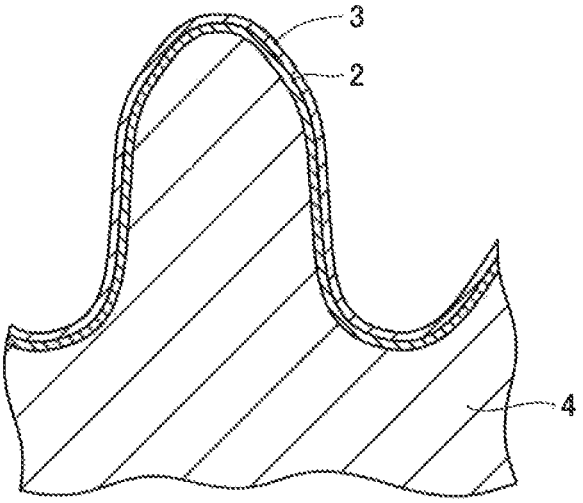
FIG. 2 shows, in enlarged view, a cross section of a portion of the machine component of the embodiment.

A gear is given as an example of the machine component. FIGS. 1 and 2 show cross sections of the gear. A machine component 1 according to an embodiment of the present invention includes a core 4 made up of a steel for machine structural use, a medium carbon-containing layer 2 formed to cover the core, and a high carbon-containing layer 3 formed to cover the medium carbon-containing layer 2. A material having the shape of the machine component formed with the steel for machine structural use can be subjected to carburizing processing, so that the medium carbon-containing layer 2 and the high carbon-containing layer 3 are generated in the surface layer of the material. Prior to describing the embodiment for carrying out the invention, a description will be made about the reasons for limiting the component composition of the steel material constituting the core 4 in the present invention and the reasons for limiting the structure of the high carbon-containing layer.

C: 0.13-0.30%

C is an element that affects hardenability, forgeability, and mechanical workability of the core of a steel component. If the content of C is less than 0.13%, sufficient hardness of the core cannot be obtained, leading to lowered strength, so C is required to be added in an amount of 0.13% or more, and is desirably added in an amount of 0.16% or more. On the other hand, C is an element that, when contained in a large amount, increases the hardness of the material and impairs workability such as machinability and forgeability. If the C content is excessive, the core of the material will become excessively hard, leading to degraded toughness. The C content is thus required to be 0.30% or less, and is desirably 0.28% or less. Accordingly, the C content is set to be 0.13-0.30%, and desirably 0.16-0.28%.

Si: 0.15-0.80%

Si is an element that is necessary for deoxidization. Si increases resistance to temper softening of the steel component, and also is effective in improving pitting characteristics. When the added amount of Si becomes 0.15% or more, the intergranular oxidation depth will decrease, so for improvement of the pitting characteristics, the Si content is required to be 0.15% or more, and is desirably 0.20% or more. On the other hand, Si is an element that, when contained in a large amount, increases the hardness of the material, impairs workability such as machinability and forgeability, and blocks carburization, thereby degrading pitting resistance strength. Thus, the Si content is required to be 0.80% or less, and is desirably 0.70% or less. Accordingly, the Si content is set to be 0.15-0.80%, and desirably greater than 0.30% and not greater than 0.70%.

Mn: 0.20-0.90%

Mn is an element that is necessary for securing hardenability. Mn also causes intergranular oxidation or is concentrated in alloy oxides during carburization, thereby forming a slack-quenched layer. To form a sufficient slack-quenched layer, the Mn content is required to be at least 0.20% or more, and is desirably 0.25% or more. On the other hand, Mn is an element that, when contained in a large amount, increases the hardness of the material, impairs workability such as machinability and forgeability, and decreases the toughness. Thus, the Mn content is required to be 0.90% or less, and is desirably 0.85% or less. Accordingly, the Mn content is set to be 0.20-0.90%, and desirably 0.25-0.85%.

P: 0.030% or Less

P is an impurity element unavoidably contained in the steel. P segregates in the grain boundary and degrades toughness. Thus, the P content is set to be greater than 0.000% and not greater than 0.030%.

S: 0.030% or Less

S is an impurity element unavoidably contained in the steel. S is bonded to Mn to form MnS, thereby degrading toughness. Thus, the S content is set to be greater than 0.000% and not greater than 0.030%. The total amount of unavoidable impurities is desirably limited to be less than 1.0%.

Cr: 0.90-2.00%

Cr is an element that improves hardenability, and also facilitates spheroidization of carbides by spheroidizing annealing. To obtain these effects, the Cr content is required to be 0.90% or more, and is desirably 1.00% or more. On the other hand, Cr is an element that, when added excessively, embrittles cementite and degrades toughness. Further, Cr is an element that, when contained in a large amount, blocks carburization, leading to reduced hardness of the material, and also forms coarse carbides during carburization, leading to lowered pitting resistance. The Cr content is thus required to be 2.00% or less, and is desirably 1.90% or less. Accordingly, the Cr content is set to be 0.90-2.00%, and desirably greater than 1.50% and not greater than 1.90%.

Al: 0.020-0.050%

Al is an element effective in deoxidization during steelmaking, and also effective in suppressing coarsening of grains, as it is bonded to N to generate AlN. To achieve the effect of suppressing coarsening of the grains, the Al content is required to be 0.020% or more. On the other hand, if Al is added in a large amount, $Al_2O_3$-type oxides will increase in the steel, becoming an origin of cracking, so the content is limited to be 0.050% or less. Accordingly, the Al content is set to be 0.020-0.050%.

N: 0.002-0.025%

N is an element that finely precipitates in the steel as Al nitride, Nb nitride, or other nitrides, and is effective in suppressing coarsening of grains which would decrease the strength such as toughness of the steel component. To obtain such effects, the N content is required to be 0.002% or more. On the other hand, if the N content is greater than 0.025%, large nitrides will increase, decreasing the steel strength and workability. Accordingly, the N content is set to be 0.002-0.025%.

Ni: 0.10-2.00%

Ni is an element effective in improving hardenability and toughness of the steel. On the other hand, Ni is an expensive element, so the cost will increase if it is contained in a large amount. Accordingly, the Ni content is set to be 0.10-2.00%.

Mo: 0.05-0.50%

Mo is an element effective in improving hardenability and toughness of the steel. On the other hand, Mo is an expensive element, so the cost will increase if it is contained in a large amount. Accordingly, the Mo content is set to be 0.05-0.50%.

Nb: 0.01-0.10%

Nb is an element that forms carbides or carbonitrides during carburization, and is effective in refining grains. Further, with the grains refined by Nb, the intergranular oxidization depth becomes shallow, and even if cracking causing intergranular oxidization occurs, the length of the cracking becomes short. However, if the Nb content is less than 0.01%, the effect of decreasing the cracking length cannot be obtained. On the other hand, if the Nb content exceeds 0.10%, the effect of refining the grains will be saturated, and the cost will increase. Further, if the Nb content exceeds 0.10%, carbonitrides can be formed in a large amount, leading to deteriorated processing property. Accordingly, the Nb content is set to be 0.01-0.10%.

V: 0.01-0.20%

V is an element that forms carbides or carbonitrides during carburization, and is effective in refining grains. Further, with the grains refined by V, the intergranular oxidization depth becomes shallow, and even if cracking causing intergranular oxidization occurs, the length of the cracking becomes short. However, if the V content is less than 0.01%, the effect of decreasing the cracking length cannot be obtained. On the other hand, if the V content exceeds 0.20%, the effect of refining the grains will be saturated, and the cost will increase. Further, if the V content exceeds 0.20%, carbonitrides can be formed in a large amount, leading to deteriorated processing property. Accordingly, the V content is set to be 0.01-0.20%.

Ti: 0.01-0.05%

Ti is an element that, when B is added, allows B to exert an effect of improving hardenability. For the improvement of hardenability, nitrogen and Ti are required to be bonded to form Ti nitride. Thus, Ti is added in an amount of 0.01% or more. It should be noted that the added amount of Ti is desirably 3.4 times or more of the added amount of N. On the other hand, Ti is an element that, when the added amount exceeds 0.05%, forms fine carbides in a large amount, thereby deteriorating processing property. Accordingly, the Ti content is set to be 0.01-0.05%.

B: 0.0010-0.0050%

B is an element that, when contained in a very small amount, considerably improves hardenability of the steel. However, if the B content is less than 0.0010%, the effect will be small. On the other hand, B is an element that, when contained in a large amount, decreases the strength. Thus, B is contained in an amount of 0.0050% or less. Accordingly, the B content is set to be 0.0010-0.0050%.

A steel material used for a machine component 1 according to an embodiment of the present invention is, for example, the following steel for machine structural use. The composition described below is the composition of a core 4 of the machine component 1.

(a) A steel for machine structural use containing: in mass %, 0.13-0.30% C, 0.15-0.80% Si, 0.20-0.90% Mn, 0.030% or less P, 0.030% or less S, 0.90-2.00% Cr, 0.020-0.050% Al, and 0.002-0.025% N, with the balance consisting of Fe and unavoidable impurities; or (b) a steel for machine structural use containing: in mass %, 0.13-0.30% C, 0.15-0.80% Si, 0.20-0.90% Mn, 0.030% or less P, 0.030% or less S, 0.90-2.00% Cr, 0.020-0.050% Al, and 0.002-0.025% N, and further containing one or more selected from among 0.10-2.00% Ni, 0.05-0.50% Mo, 0.01-0.10% Nb, and 0.01-0.20% V, with the balance consisting of Fe and unavoidable impurities; or (c) a steel for machine structural use containing: in mass %, 0.13-0.30% C, 0.15-0.80% Si, 0.20-0.90% Mn, 0.030% or less P, 0.030% or less S, 0.90-2.00% Cr, 0.020-0.050% Al, and 0.002-0.025% N, and further containing 0.01-0.05% Ti and 0.0010-0.0050% B, with the balance consisting of Fe and unavoidable impurities; or (d) a steel for machine structural use containing: in mass %, 0.13-0.30% C, 0.15-0.80% Si, 0.20-0.90% Mn, 0.030% or less P, 0.030% or less S, 0.90-2.00% Cr, 0.020-0.050% Al, and 0.002-0.025% N, further containing one or more selected from among 0.10-2.00% Ni, 0.05-0.50% Mo, 0.01-0.10% Nb, and 0.01-0.20% V, and still further containing 0.01-0.05% Ti and 0.0010-0.0050% B, with the balance consisting of Fe and unavoidable impurities.

Figure 3:
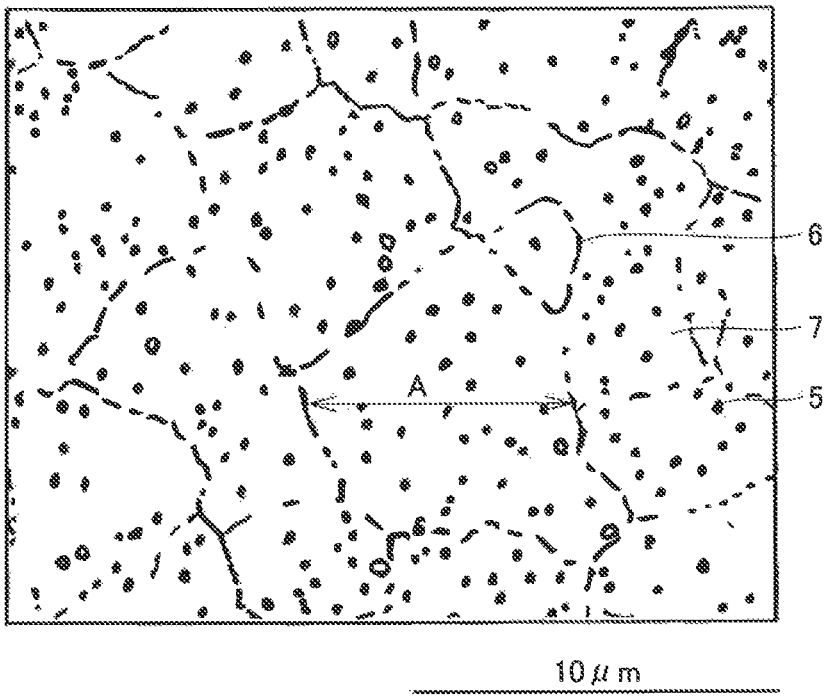
FIG. 3 shows a structure of a high carbon layer of the machine component of the embodiment.

Regarding the machine component of the present invention using the steel material with the component composition described above, the reasons for defining its properties will now be described in detail. The properties are attributable mainly to the structure of a high carbon-containing layer 3 at an outermost surface of the machine component 1. A description will be made below about the requirements regarding the structure of the high carbon-containing layer 3. The carbides in the high carbon-containing layer are mainly cementite ($Fe_3C$), so in the following description, the carbides are regarded as cementite. The carbides may include, besides cementite, $M_{23}C_6$-type carbides, $(FeCr)_3C$, and the like. FIG. 3 shows a structure of the high carbon-containing layer 3.

(A) That the high carbon-containing layer is made up of a martensitic structure 7 with spheroidized cementite 5 dispersed therein and a residual austenitic structure 7, wherein the spheroidized cementite particles 5 having an aspect ratio of 1.5 or less constitute 90% or more of the entire cementite.

The aspect ratio defining the ratio of major axis to minor axis of the spheroidized cementite 5 is an index of spheroidization. A cementite particle with a large aspect ratio, such as one having a plate-like shape or nearly columnar shape, becomes a source of stress concentration during deformation due to its shape, and further becomes an origin of cracking, degrading toughness. Thus, the cementite particle is desirably close to a spherical shape from the standpoint of improved toughness. When the aspect ratio is 1.5 or less, the potential harm of becoming an origin of cracking can be reduced. Thus, the greater proportion of the spheroidized cementite particles with the aspect ratio of 1.5 or less is more preferable.

It is thus caused such that the spheroidized cementite particles with the aspect ratio of 1.5 or less constitute 90% or more, and desirably 95-100%, of the total number of cementite particles.

(B) That as to the cementite particles on the prior austenite grain boundaries 6, the proportion of the number of spheroidized cementite particles 5 on the prior austenite grain boundaries 6 to the total number of cementite particles is 40% or less.

The structure of the high carbon-containing layer 3 falls within the range of hypereutectoid steel in terms of carbon concentration. In a hypereutectoid steel, the mode of brittle fracture degrading the shock resistance property is primarily intergranular fracture along the prior austenite grain boundaries 6. This is caused by cementite on the prior austenite grain boundaries 6, or particularly, reticular carbides along the grain boundaries. Cementite particles that precipitate and exist on the grain boundaries are more likely to become an origin of fracture and more harmful as compared to cementite particles in the grains. Accordingly, it is not preferable that such cementite particles exist on the grain boundaries. Thus, the proportion of the number of spheroidized cementite particles 5 on the prior austenite grain boundaries to the entire cementite is set to be 40% or less, desirably 20% or less, and further desirably 5% or less to 0%.

(C) That 90% or more of the spheroidized cementite particles 5 on the prior austenite grain boundaries 6 have a particle size of 1 μm or less.

It is not preferable that cementite exists on the prior austenite grain boundaries 6. In particular, reticular cementite particles or similarly coarse cementite particles along the grain boundaries have an increased risk of becoming an origin of intergranular fracture. Therefore, it is adjusted such that 90% or more, and desirably 95-100%, of the spheroidized cementite particles 5 have a particle size of 1 μm or less, which is low in harmfulness.

It should be noted that % used herein is the proportion when the total number of carbides observable by a scanning electronic microscope of a magnification about 5000 is set to be 100%. Very fine carbides that cannot be observed with that magnification power are not taken into account, as they will hardly affect the toughness.

(D) That the prior austenite grain boundaries 6 provide a grain size of 15 μm or less.

Reducing the grain size A, corresponding to the length across the prior austenite grain boundary 6, can decrease the fracture facet size of intergranular fracture or cleavage fracture, and increase the energy required for the fracture, leading to improved toughness. Reducing the grain size is thus a very effective way of improving the toughness without degrading the hardness.

In the producing method in the present invention, final quenching is performed in the state where the fine cementite particles have been precipitated, and the quenching is performed at a relatively low temperature. This is advantageous in that the prior austenite grain size can be kept fine.

On the other hand, if the grain size provided by the prior austenite grain boundaries 6 exceeds 15 μm, the effect of improving toughness will become small. Particularly, when carburization is performed at the heating temperature of 1050° C. or higher, the prior austenite grain size will become large even if the final quenching is performed. In consideration of the foregoing, the prior austenite grain boundaries 6 are caused to provide the grain size of 15 μm or less.

The above structure has fine carbides precipitated therein, which was generally hardly obtainable with typical carburizing processing. While Patent Literature 1 describes a steel material having the C content of 0.55-1.10% in which carbides are precipitated, precipitation of fine carbides in a steel with a low carbon content, such as one having the C content (0.13-0.30%) as in the above embodiment, would not have been conceived before.

The medium carbon-containing layer 2 is located between the core 4 and the high carbon-containing layer 3. The medium carbon-containing layer 2 has the C content of a medium level that is higher than that of the core 4 and lower than that of the high carbon-containing layer 3. The structure of the medium carbon-containing layer 2 is substantially martensitic. The medium carbon-containing layer 2 has fine carbides, with low density, precipitated in its region near the high carbon-containing layer 3.

The embodiment for carrying out the invention will now be described using examples. It should be noted that % used for the component composition is mass %.

Steels having the component compositions shown in Table 1, with the balance consisting of Fe and unavoidable impurities, were produced in a 100-kg vacuum melting furnace. The obtained steels were drawn out at 1250° C. to obtain bar steels of 32 mm in diameter, which were then normalized at 925° C. for an hour.

Of the test samples shown in Table 1, the test samples Nos. 1 to 10 have the component compositions falling within the scope of the present invention. The test samples Nos. 11 to 18 have the component compositions falling outside the scope of the present invention. The underlined values fall outside the scope of the present invention. Ni in an amount of 0.09% or less and Mo in an amount of 0.04% or less are impurities.

Figure 4:
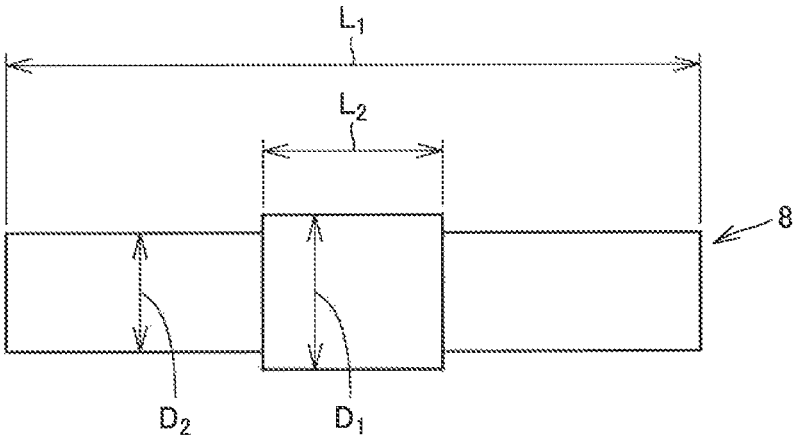
FIG. 4 shows a shape of a roller pitting test specimen.

Each test sample was roughly shaped (roughly machined) into a roller pitting test specimen (small roller) (1) shown in FIG. 4. During this rough machining, finishing work was performed on the part (2) to be tested. An excess thickness of 0.2 mm was applied to a grip section (3) alone, in preparation for grinding finishing after the subsequent heat treatment. Each test sample was also roughly shaped into a 10R C-notched Charpy impact test specimen (1). During this rough machining, an excess thickness of 2 mm was applied to portions other than the notch surface, in preparation for working to eliminate the carburized layer after the subsequent heat treatment.

TABLE 1

(unit: mass %)

| | No. | C | Si | Mn | P | S | Cr | Ni | Mo | V | Nb | Al | N | Ti | B |
|---|---|---|---|---|---|---|---|---|---|---|---|---|---|---|---|
| Test Samples | 1 | 0.13 | 0.80 | 0.35 | 0.015 | 0.016 | 1.61 | 0.06 | 0.03 | — | — | 0.024 | 0.016 | — | — |
| | 2 | 0.18 | 0.24 | 0.85 | 0.011 | 0.004 | 0.90 | — | 0.02 | 0.01 | — | 0.030 | 0.018 | — | — |
| | 3 | 0.23 | 0.54 | 0.26 | 0.014 | 0.009 | 1.82 | 0.06 | 0.02 | — | 0.04 | 0.028 | 0.018 | — | — |
| | 4 | 0.25 | 0.31 | 0.80 | 0.014 | 0.013 | 1.19 | 0.10 | 0.15 | — | — | 0.030 | 0.015 | — | — |
| | 5 | 0.16 | 0.70 | 0.20 | 0.009 | 0.004 | 1.50 | 0.03 | 0.03 | — | 0.07 | 0.050 | 0.025 | — | — |
| | 6 | 0.20 | 0.15 | 0.40 | 0.007 | 0.013 | 1.00 | 0.02 | — | — | — | 0.028 | 0.015 | 0.05 | 0.005 |
| | 7 | 0.28 | 0.26 | 0.25 | 0.022 | 0.019 | 2.00 | 0.08 | 0.02 | — | 0.10 | 0.035 | 0.014 | — | — |
| | 8 | 0.30 | 0.20 | 0.43 | 0.016 | 0.012 | 1.25 | 0.07 | 0.50 | 0.20 | 0.01 | 0.020 | 0.017 | — | — |
| | 9 | 0.22 | 0.44 | 0.90 | 0.015 | 0.021 | 1.90 | 2.00 | 0.05 | — | — | 0.028 | 0.002 | — | — |
| | 10 | 0.18 | 0.25 | 0.80 | 0.015 | 0.012 | 1.02 | 0.07 | 0.15 | — | — | 0.032 | 0.016 | — | — |
| | 11 | 0.12 | 0.55 | 0.55 | 0.015 | 0.011 | 2.10 | 0.16 | 0.07 | — | — | 0.027 | 0.017 | — | — |
| | 12 | 0.16 | 0.13 | 0.29 | 0.010 | 0.016 | 1.05 | 0.06 | 0.03 | — | — | 0.024 | 0.014 | — | — |
| | 13 | 0.20 | 0.33 | 0.85 | 0.018 | 0.008 | 0.85 | 0.07 | 0.02 | — | — | 0.033 | 0.018 | — | — |
| | 14 | 0.32 | 0.41 | 0.33 | 0.007 | 0.012 | 1.88 | 0.08 | 0.04 | — | — | 0.028 | 0.016 | — | — |
| | 15 | 0.27 | 0.48 | 0.91 | 0.024 | 0.033 | 1.85 | 0.11 | 0.09 | — | — | 0.027 | 0.015 | — | — |
| | 16 | 0.22 | 0.25 | 0.77 | 0.033 | 0.011 | 1.03 | 0.09 | 0.03 | — | — | 0.030 | 0.019 | — | — |
| | 17 | 0.20 | 0.85 | 0.81 | 0.011 | 0.009 | 1.09 | 0.13 | 0.15 | — | — | 0.025 | 0.022 | — | — |
| | 18 | 0.19 | 0.30 | 0.19 | 0.017 | 0.002 | 1.16 | 1.60 | 0.20 | — | — | 0.032 | 0.020 | | |

Table 2 is a table listing the conditions for heat treatment etc. of components using the test samples Nos. 1 to 18 shown in Table 1. The component compositions of the inventive steel components Nos. 1 to 10 and the comparative steel components Nos. 11 to 18 in Table 2 correspond respectively to those of the test samples Nos. 1 to 18 shown in Table 1.

Firstly, these components were each subjected to gas carburizing under the heating condition shown in Table 2, so as to attain the carbon concentration in the surface of the test specimen as shown in Table 2. The components were then cooled to 200° C. or lower at the cooling rate shown in Table 2. With the gas carburizing, a carburized layer is formed on the component surface. From the carburized layer, a high carbon-containing layer and a medium carbon-containing layer are generated through the following processing.

The components were each subjected to spheroidizing annealing in which it was held at the re-heating temperature shown in Table 2. In the present invention, the carbides are required to be grown to an appropriate size and distributed with an appropriate area ratio. To this end, the spheroidizing annealing needs to be performed at a heating temperature not higher than the $A_{cm}$ point (° C.). The spheroidizing annealing temperatures in the present examples are all not higher than the $A_{cm}$ point (° C.).

The components were each held at the re-heating temperature shown in Table 2, and then quenched. Thereafter, they were tempered, in which they were held at 180° C. for 1.5 hours and then air cooled. The obtained components were finished as the roller pitting test specimen (small roller) (1) and the Charpy impact test specimen.

In the present embodiment, during the process from gas carburizing via spheroidizing annealing to quenching, the components were once cooled to a room temperature for each step. Alternatively, the process may proceed to the next step once the temperature has become lower than the $A_1$ point.

TABLE 2

| | No. | Heating Temperature (° C.) | Carbon Concentration in Carburized Surface Layer (%) | Cooling Rate after Carburization (° C./s) | Re-Heating Temperature (° C.) |
|---|---|---|---|---|---|
| Inventive Steel Components | 1 | 1030 | 0.8 | 0.3 | 850 |
| | 2 | 940 | 0.9 | 0.4 | 840 |
| | 3 | 950 | 0.9 | 0.2 | 870 |
| | 4 | 950 | 0.9 | 0.3 | 850 |
| | 5 | 960 | 0.8 | 3.0 | 830 |
| | 6 | 960 | 1.0 | 5.0 | 860 |
| | 7 | 940 | 1.5 | 0.7 | 850 |
| | 8 | 850 | 0.9 | 0.4 | 840 |
| | 9 | 940 | 0.9 | 0.8 | 850 |
| | 10 | 960 | 0.9 | 0.3 | 840 |
| Comparative Steel Components | 11 | 1020 | 0.9 | 1.8 | 840 |
| | 12 | 960 | 1.0 | 5.5 | 850 |
| | 13 | 940 | 0.8 | 0.5 | 800 |
| | 14 | 880 | 0.9 | 0.4 | 880 |
| | 15 | 940 | 1.4 | 0.2 | 850 |
| | 16 | 950 | 0.8 | 0.7 | 780 |
| | 17 | 950 | 0.8 | 0.3 | 820 |
| | 18 | 960 | 0.9 | 0.5 | 820 |

Re-heating temperature means spheroidizing annealing temperature and final quenching temperature.

Figure 5:
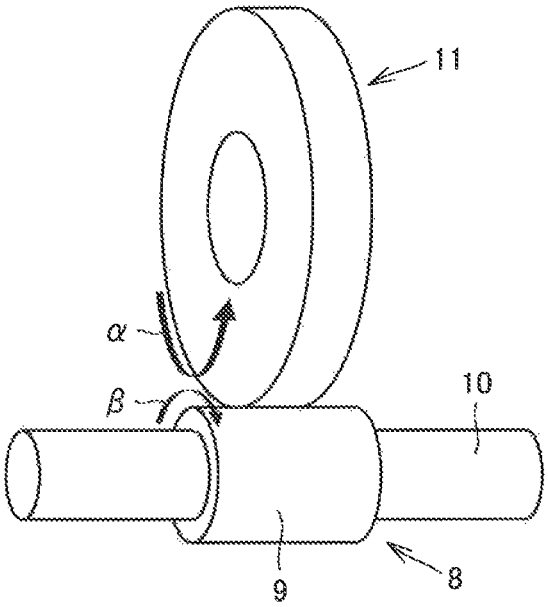
FIG. 5 shows a concept of a roller pitting test.

Next, the roller pitting test specimen (small roller) 8 shown in FIG. 4, which was produced as explained above, and a large roller test specimen 11 shown in FIG. 5, to be brought into contact with the small roller 8 via oil film in the state where lubricity is applied, were used to perform the roller pitting test shown in FIG. 5 under the conditions listed in Table 3. In the listed conditions, the slip ratio being 40% means that the circumferential velocity of the large roller 11 is slower by 40% than the circumferential velocity of the small roller 8. Lubricant: ATF (Automatic Transmission Fluid) means lubricating oil that is used for automatic transmissions of vehicles. The crowning amount 150R means that the outer periphery of the roller has an arc shape with the radius of 150 mm in the rotational axis direction.

TABLE 3

| | |
|---|---|
| Slip Ratio | −40% |
| Surface Pressure | 3.3 GPa |
| Number of Revolutions of Small Roller | 2000 rpm |
| Large Roller Test Specimen (Counterpart) | SCM420 Carburized and Polished Member |
| Large Roller Crowning Amount | 150R |
| Lubricant | ATF |
| Oil Temperature | 80° C. |

The roller pitting test was conducted to detect, using a vibrometer, excessive vibration due to peeling or excessive deformation, and to stop the test upon detection of such vibration. The number of cycles until stoppage of the test was regarded as a life of the test specimen. Further, the Charpy impact test was conducted at a room temperature for evaluation of toughness.

For investigation of the grain size, the roller pitting test specimen (small roller) 8 that had undergone up to the tempering described above was cut into a test piece, and the test piece was embedded in resin so as to enable observation of the cross section from the surface layer to the inside. The region to be inspected was subjected to mirror polishing and intergranular corrosion. Then, an optical microscope was used to image an average view field in the range from the outermost surface to 0.3 mm beneath the surface, to obtain an average grain size (diameter).

For observation of carbides, the test piece was embedded in resin, as in the case described above. The region to be inspected was mirror-polished and then corroded with nital. A scanning electronic microscope was used to image an average view field in the range from the outermost surface to 0.3 mm beneath the surface, to obtain an image of microstructure, as shown in FIG. 3, in which carbides are shown identified. For the identified carbides, image analysis was conducted to confirm: the proportion of cementite particles with an aspect ratio of 1.5 or less in the carbides (%), the proportion of the number of cementite particles on the prior austenite grain boundaries (%), the proportion of cementite particles with a particle size exceeding 1 μm on the prior austenite grain boundaries (%), and the prior austenite grain size (μm).

It should be noted that, for the test specimens that have undergone, following the tempering, surface treatment of one or more of cutting, grinding, polishing, shot blasting, shot peening, hard shot peening, and fine particle shot peeling, observations similar to those described above were performed by regarding the treated surface as the surface layer.

The test results are shown in Table 4. The Charpy impact value and pitting resistance are shown with respect to those of the comparative steel component No. 13, which was produced using the test sample No. 13 in Table 1, a steel corresponding to JIS SCr420. The Charpy impact value of each of the inventive steel components Nos. and the comparative steel components Nos. in Table 4 is indicated in Table 4 relative to the Charpy impact value of the comparative steel component No. 13. At this time, it was determined that the toughness was good when the ratio of the Charpy impact value was 1.5 or more. The pitting resistance of each of the inventive steel components Nos. and the comparative steel components Nos. in Table 4 is indicated as a ratio in Table 4 when the number of cycles until occurrence of pitting in the comparative steel component No. 13 is set to be 1. At this time, it was determined that the pitting resistance was good when the ratio of the number of cycles until the occurrence of pitting was 2.0 or more.

TABLE 4

| | No. | Proportion of cementite particles with aspect ratio of 1.5 or less (%) | Proportion of number of cementite particles on prior austenite grain boundaries (%) | Proportion of cementite particles with particle size exceeding 1 μm on prior austenite grain boundaries (%) | Prior austenite grain size (μm) | Charpy impact value | Pitting resistance |
|---|---|---|---|---|---|---|---|
| Inventive Steel Components | 1 | 95 | 25 | 5 | 8 | 2.5 | 2.5 |
| | 2 | 94 | 34 | 4 | 5 | 2.2 | 2.7 |
| | 3 | 97 | 15 | 4 | 5 | 2.0 | 2.6 |
| | 4 | 93 | 40 | 6 | 6 | 1.8 | 2.9 |
| | 5 | 92 | 23 | 7 | 5 | 2.2 | 2.4 |
| | 6 | 94 | 36 | 5 | 4 | 1.8 | 2.5 |
| | 7 | 90 | 11 | 3 | 4 | 1.7 | 2.6 |
| | 8 | 95 | 23 | 5 | 4 | 1.6 | 2.9 |
| | 9 | 98 | 12 | 4 | 5 | 1.9 | 2.4 |
| | 10 | 93 | 36 | 6 | 6 | 2.3 | 2.2 |
| Comparative Steel Components | 11 | 83 | 14 | 14 | 10 | 0.8 | 1.4 |
| | 12 | 92 | 36 | 8 | 6 | 0.8 | 0.8 |
| | 13 | 90 | 25 | 9 | 5 | 1.0 | 1.0 |
| | 14 | 95 | 45 | 15 | 4 | 0.7 | 0.8 |
| | 15 | 85 | 48 | 13 | 6 | 0.7 | 1.3 |
| | 16 | 92 | 32 | 7 | 6 | 0.9 | 1.1 |
| | 17 | 91 | 30 | 8 | 5 | 1.3 | 0.3 |
| | 18 | 93 | 33 | 6 | 6 | 1.2 | 0.8 |

Referring to Tables 1 and 2, for the inventive steel components Nos. 1 to 10 which were produced by using the test samples Nos. 1 to 10 with the component compositions in Table 1 under the conditions listed in Table 2, firstly, as shown in Table 4, the cementite particles with the aspect ratio of 1.5 or less constituted 90-98%, or, 90% or more, in the inventive steel components Nos. 1 to 10. That is to say, while a cementite particle with a large aspect ratio would become a source of stress concentration during deformation due to its shape and would become an origin of cracking and degrade toughness, the proportion of such cementite particles is small, so the toughness is improved instead of being degraded.

Further, for the inventive steel components Nos. 1 to 10, the proportion of the number of spheroidized cementite particles on the prior austenite grain boundaries to the total number of cementite particles was 11-40%, or, 40% or less. Further, in the inventive steel components Nos. 1 to 10, the spheroidized cementite particles on the prior austenite grain boundaries having the particle size exceeding 1 μm accounted for 3-7%. That is to say, 90% or more of the spheroidized cementite particles on the prior austenite grain boundaries had a particle size of 1 μm or less. While the cementite particles that precipitate and exist on the prior austenite grain boundaries (particularly, reticular carbides along the grain boundaries) are more likely to become an origin of fracture and more harmful as compared to the cementite particles in the grains, in the present invention, the cementite particles on the grain boundaries have been reduced to 40% or less, and 90% or more of them had the size of 1 μm or less, which is low in harmfulness.

Further, in the inventive steel components Nos. 1 to 10, the prior austenite grain size was 4-8 μm, or, all 8 μm or less. Reducing the prior austenite grain size can decrease the fracture facet size of intergranular fracture or cleavage fracture, and increase the energy required for the fracture, thereby improving the toughness. The machine component according to the present invention thus has improved toughness.

In the inventive steel components Nos. 1 to 10, the Charpy impact ratio relative to 1.0 of the comparative steel component No. 13 was 1.6 to 2.9, or, 1.5 or more, indicating high toughness.

Similarly, in the inventive steel components Nos. 1 to 10, the ratio of the number of cycles until occurrence of pitting, relative to 1.0 of the comparative steel component No. 13, was 2.2 to 2.9, indicating good pitting resistance.

As seen from the above, the machine components of the present invention all exhibit excellent pitting resistance characteristics and excellent toughness.

It should be understood that the embodiment and examples disclosed herein are illustrative and non-restrictive in every respect. The scope of the present invention is defined by the terms of the claims, rather than the description above, and is intended to include any modifications within the scope and meaning equivalent to the terms of the claims.

DESCRIPTION OF REFERENCE NUMERALS

1: gear (machine component); 2: medium carbon-containing layer; 3: high carbon-containing layer; 4: core; 5: spheroidized cementite (spheroidized carbide); 6: prior austenite grain boundary; 7: martensitic structure or residual austenitic structure; 8: roller pitting test specimen (small roller); 9: part to be tested; 10: grip section; 11: large roller test specimen; and A: grain size.

The invention claimed is:

1. A machine component comprising:

a core made up of a steel for machine structural use; and a medium carbon-containing layer and a high carbon-containing layer formed of the steel for machine structural use, the medium carbon-containing layer covering the core, the high carbon-containing layer covering the medium carbon-containing layer and having a carbon concentration of 0.8-1.5%;

the steel for machine structural use containing, in mass %, 0.13-0.30% C, 0.15-0.80% Si, 0.20-0.90% Mn, 0.90-2.00% Cr, 0.020-0.050% Al, and 0.002-0.025% N, also containing, as impurities, 0.030% or less P and 0.030% or less S, further optionally containing, as a first group of selective optional components, one or more selected from among 0.10-2.00% Ni, 0.05-0.50% Mo, 0.01-0.10% Nb, and 0.01-0.20% V, and optionally containing, as a second group of optional components in addition to or in place of the first group of selective optional components, 0.01-0.05% Ti and 0.0010-0.0050% B, with the balance consisting of Fe and unavoidable impurities, the high carbon-containing layer being made up of a martensitic structure having carbides dispersed therein and a residual austenitic structure, spheroidized carbides with an aspect ratio of 1.5 or less constituting 90% or more of a total number of the carbides, the number of spheroidized carbides on prior austenite grain boundaries being 40% or less of the total number of the carbides.

2. The machine component according to claim 1, wherein 90% or more of the spheroidized carbides on the prior austenite grain boundaries have a particle size of 1 μm or less.

3. The machine component according to claim 1, wherein the prior austenite grain boundaries provide a grain size of 15 μm or less.

4. The machine component according to claim 1, wherein the high carbon-containing layer is formed at least from a surface to 0.3 mm in depth of the machine component.

5. The machine component according to claim 2, wherein the prior austenite grain boundaries provide a grain size of 15 μm or less.

* * * * *